US009534183B2

(12) United States Patent
Papin et al.

(10) Patent No.: US 9,534,183 B2
(45) Date of Patent: Jan. 3, 2017

(54) ADDITIVE COMPOSITIONS AND USE THEREOF FOR IMPROVING THE COLD PROPERTIES OF FUELS AND COMBUSTIBLES

(71) Applicant: TOTAL MARKETING SERVICES, Puteaux (FR)

(72) Inventors: Géraldine Papin, Lyons (FR); Nelly Dolmazon, Serezin du Rhone (FR); Frédéric Tort, Brignais (FR)

(73) Assignee: Total Marketing Services, Puteaux (FR)

( * ) Notice: Subject to any disclaimer, the term of this patent is extended or adjusted under 35 U.S.C. 154(b) by 51 days.

(21) Appl. No.: 14/408,324

(22) PCT Filed: Jun. 17, 2013

(86) PCT No.: PCT/EP2013/062472
§ 371 (c)(1),
(2) Date: Dec. 16, 2014

(87) PCT Pub. No.: WO2013/189868
PCT Pub. Date: Dec. 27, 2013

(65) Prior Publication Data

US 2015/0113863 A1 Apr. 30, 2015

(30) Foreign Application Priority Data

Jun. 19, 2012 (FR) ..... 12 55755

(51) Int. Cl.

| | |
|---|---|
| ***C10L 10/00*** | (2006.01) |
| ***C10L 10/14*** | (2006.01) |
| ***C10L 1/14*** | (2006.01) |
| ***C10L 1/22*** | (2006.01) |
| ***C10L 1/238*** | (2006.01) |
| ***C10L 1/10*** | (2006.01) |
| *C10L 1/196* | (2006.01) |
| *C10L 1/197* | (2006.01) |
| *C10L 1/222* | (2006.01) |
| *C10L 1/224* | (2006.01) |
| *C10L 1/236* | (2006.01) |
| *C10L 1/2383* | (2006.01) |

(52) U.S. Cl.
CPC ..... *C10L 10/14* (2013.01); *C10L 1/10* (2013.01); *C10L 1/143* (2013.01); *C10L 1/146* (2013.01); *C10L 1/22* (2013.01); *C10L 1/221* (2013.01); *C10L 1/238* (2013.01); *C10L 1/196* (2013.01); *C10L 1/1963* (2013.01); *C10L 1/1973* (2013.01); *C10L 1/224* (2013.01); *C10L 1/2222* (2013.01); *C10L 1/2225* (2013.01); *C10L 1/2364* (2013.01); *C10L 1/2383* (2013.01); *C10L 2200/0259* (2013.01); *C10L 2250/04* (2013.01)

(58) Field of Classification Search
CPC ..... C10L 10/14; C10L 1/10; C10L 1/22; C10L 1/221; C10L 1/146; C10L 1/143; C10L 1/1963; C10L 1/1973; C10L 1/2222; C10L 1/2225; C10L 1/224; C10L 1/2364; C10L 1/238; C10L 1/196; C10L 1/2383; C10L 2200/0259; C10L 2250/04
See application file for complete search history.

(56) References Cited

U.S. PATENT DOCUMENTS

| | | | |
|---|---|---|---|
| 3,166,387 | A | 1/1965 | Ebner et al. |
| 3,980,569 | A | 9/1976 | Pindar et al. |
| 4,147,520 | A | 4/1979 | Ilnyckyj |
| 4,511,369 | A | 4/1985 | Denis et al. |
| 4,652,273 | A | 3/1987 | Maldonado et al. |
| 4,664,676 | A | 5/1987 | Denis et al. |
| 4,731,095 | A | 3/1988 | Garapon et al. |
| 4,900,332 | A | 2/1990 | Denis et al. |
| 5,039,437 | A | 8/1991 | Martella et al. |
| 5,106,515 | A | 4/1992 | Denis et al. |
| 5,256,740 | A | 10/1993 | Denis et al. |
| 5,449,386 | A | 9/1995 | Denis et al. |
| 5,456,730 | A | 10/1995 | Hart et al. |

(Continued)

FOREIGN PATENT DOCUMENTS

| | | | |
|---|---|---|---|
| CA | 2145168 | A1 | 3/1994 |
| CA | 2154344 | A1 | 8/1994 |

(Continued)

*Primary Examiner* — Cephia D Toomer

(74) *Attorney, Agent, or Firm* — Harness, Dickey & Pierce, P.L.C.

(57) ABSTRACT

The present disclosure relates to additive compositions and their use for improving the low temperature properties of motor fuels and fuels. The additive compositions include at least one modified alkylphenol-aldehyde resin and at least one filterability additive chosen from:

the terpolymers of $C_4$ to $C_{22}$ alkyl (meth)acrylate, $C_{20}$ to $C_{24}$ alpha-olefin and maleimide N-substituted by a hydrocarbon chain having between 4 and 30 carbon atoms, the homopolymers of $C_1$ to $C_{40}$ alkyl (meth)acrylate, preferably the $C_8$ to $C_{24}$ alkyl polyacrylates, the ammonium salts of mono- or poly-carboxylic acid comprising at least one linear or branched, saturated or unsaturated hydrocarbon chain, having between 4 and 30 carbon atoms.

The present disclosure also relates to compositions of motor fuels or liquid hydrocarbon fuels including such compositions.

20 Claims, No Drawings

(56) References Cited

U.S. PATENT DOCUMENTS

| | | | | |
|---|---|---|---|---|
| 5,730,029 | A | 3/1998 | Stoldt et al. | |
| 5,998,530 | A | 12/1999 | Krull et al. | |
| 6,071,318 | A | 6/2000 | Mallet et al. | |
| 6,083,287 | A | 7/2000 | Germanaud et al. | |
| 6,232,277 | B1 | 5/2001 | Ledeore et al. | |
| 6,511,520 | B1 | 1/2003 | Eber et al. | |
| 6,592,639 | B2 | 7/2003 | Bernasconi et al. | |
| 8,298,402 | B2 | 10/2012 | Krull et al. | |
| 9,169,452 | B2 * | 10/2015 | Dolmazon | C08G 8/12 |
| 2005/0223631 | A1 | 10/2005 | Jackson | |
| 2012/0010112 | A1 | 1/2012 | Grabarse et al. | |
| 2013/0255139 | A1 | 10/2013 | Dolmazon et al. | |
| 2014/0157655 | A1 | 6/2014 | Tort et al. | |

FOREIGN PATENT DOCUMENTS

| | | | |
|---|---|---|---|
| EP | 0261959 | A2 | 3/1988 |
| EP | 0271385 | A1 | 6/1988 |
| EP | 0674689 | A1 | 10/1995 |
| EP | 1584673 | A1 | 10/2005 |
| FR | 2772783 | A1 | 6/1999 |
| GB | 2121808 | A | 1/1984 |
| NZ | 202674 | A | 5/1986 |
| WO | WO-9314178 | A1 | 7/1993 |
| WO | WO-9804656 | A1 | 2/1998 |
| WO | WO-2009106743 | A2 | 9/2009 |
| WO | WO-2009106744 | A2 | 9/2009 |
| WO | WO-2012004300 | A1 | 1/2012 |

* cited by examiner

ADDITIVE COMPOSITIONS AND USE THEREOF FOR IMPROVING THE COLD PROPERTIES OF FUELS AND COMBUSTIBLES

CROSS-REFERENCE TO RELATED APPLICATIONS

This application is a National Phase Entry of International Application No. PCT/EP2013/062472, filed on Jun. 17, 2013, which claims priority to French Patent Application Serial No. 1255755, filed on Jun. 19, 2012, both of which are incorporated by reference herein.

TECHNICAL FIELD

The present invention relates to additive compositions and their use in motor fuels and liquid hydrocarbon fuels for improving their low temperature properties. In particular, the present invention relates to additive compositions and the use thereof as filterability additives for motor fuels and liquid hydrocarbon fuels.

BACKGROUND AND SUMMARY

Crude oils or crude petroleums and the middle distillates obtained from crude oils of petroleum origin by distillation, such as gas oil, diesel motor fuel or domestic fuel oil, contain, depending on the origin of these crude oils, different quantities of n-alkanes or n-paraffins which at a low temperature, typically below 0° C., crystallize out as lamellar crystals which have a tendency to agglomerate. There is then a deterioration in the flow characteristics of the oils and distillates. Difficulties occur during transport, and/or storage of the oil or fuel. The wax crystals have a tendency to clog and block pipes, fuel lines, pumps and filters, for example in vehicle fuel systems.

In winter or in conditions of use of the oil, petroleum or the distillate at a temperature close to below 0° C., the crystallization phenomena can lead to deposits on the fuel line walls, even to a complete blockage. These problems are well known in the field of motor fuels and liquid hydrocarbon fuels where numerous additives or mixtures of additives have been proposed and are marketed for reducing the size of the wax crystals and/or changing their shape and/or preventing their formation. The smallest possible crystal size is preferred as it minimizes the risks of blockage or clogging the filter.

The usual agents for improving the flow of crude oils and middle distillates are co- and ter-polymers of ethylene and vinyl and/or acrylic ester(s) alone or in a mixture with low molecular weight oil-soluble compounds or polymers which contain one or more ester, amide, imide, ammonium groups substituted by at least one alkyl chain. Apart from improving the flow of the oil and the distillate, another purpose of the additives for improving the flow is to ensure the dispersion of the wax crystals so as to delay or prevent the settling of the wax crystals and therefore the formation of a layer rich in waxes at the bottom of receptacles, vessels or storage tanks. These additives for dispersing waxes are called WASA (acronym for the term wax anti-settling additive).

The alkylphenol-aldehyde resins originating from the condensation of alkylphenol and aldehyde have been known for a long time as agents for improving the flow of mineral oils: see for example EP 311 452 which describes condensation products of at least 80% mol of dialkylphenols and aldehydes having 1 to 30 carbon atoms; EP0857776 which describes the use of alkylphenol-aldehyde resins in which the alkyl groups of the alkylphenol have 4 to 12 carbon atoms and the aldehyde has 1 to 4 carbon atoms and containing no more than 10% mol of alkylphenols having more than one alkyl group, in combination with ethylene/vinyl ester co- or ter-polymers for improving the fluidity of mineral oils; EP1584673 which describes alkylphenol-aldehyde resins of Mn between 1000 and 3000 originating from the condensation of a C1-C4 aldehyde and a mixture of alkylphenols with a majority of monoalkylphenol, the alkyl group having 1 to 20 carbon atoms intended to improve the low temperature flow properties of motor fuel compositions. Modified alkylphenol-aldehyde resins have also been proposed as additives for improving the low temperature flow of mineral oils: EP1767610 describes alkylphenol resins the condensation reaction of which with the aldehydes is carried out in the presence of fatty acids having 2 to 50 carbon atoms, or their derivatives, such as esters. Recently, the applicant company in patent applications with filing numbers FR2010/61193 and PCT/IB2011/055863 has proposed novel modified alkylphenol-aldehyde resins which can be used for improving the low temperature stability of motor fuels and liquid hydrocarbon fuels and more particularly by limiting the settling of waxes contained in the motor fuels and fuels at low temperature.

These modified alkylphenol-aldehyde resins can be obtained by a Mannich reaction of an alkylphenol-aldehyde condensation resin

- with at least one aldehyde and/or one ketone having 1 to 8 carbon atoms, preferably 1 to 4 carbon atoms;
- and at least one hydrocarbon compound having at least one alkylmonoamine or alkylpolyamine group (i.e. having several amine groups) having between 4 and 30 carbon atoms,
- the alkylphenol-aldehyde condensation resin can itself be obtained by condensation
- of at least one alkylphenol substituted by at least one linear or branched alkyl group having 1 to 30 carbon atoms, preferably a monoalkylphenol,
- with at least one aldehyde and/or one ketone having 1 to 8 carbon atoms, preferably 1 to 4 carbon atoms.

In continuing its work, the applicant company has discovered that a specific combination of such modified alkylphenol-aldehyde resins with at least one specific filterability additive makes it possible to further improve the low temperature properties, in particular the low temperature behaviour of motor fuels and liquid hydrocarbon fuels. The applicant company has, in particular, discovered an additive composition making it possible to reduce the cold filter-plugging point while maintaining the dispersant and/or anti-settling effect of the modified alkylphenol-aldehyde resins described in patent applications FR2010/61193 and PCT/162011/055863.

The purpose of the present invention consists of proposing additive compositions for improving the low temperature behaviour of the motor fuels and liquid hydrocarbon fuels, in particular, the boiling temperature range of which is comprised between 100 and 500° C., even above 500° C. Another purpose of the present invention consists of proposing improved additive compositions for reducing the cold filter-plugging point while limiting the settling of waxes. The present invention also relates to an additive composition capable of being added to motor fuels and liquid hydrocarbon fuels comprising at least one additional filterability additive for reducing the cold filter-plugging point without affecting the effectiveness of the modified alkylphenol-aldehyde resin on the dispersion and/or the settling of waxes.

The present invention relates, in particular, to a composition of motor fuels and liquid hydrocarbon fuels having a low cold filter-plugging point (according to the standard NF EN 116), advantageously less than or equal to −25° C., preferably less than or equal to −27° C., more preferentially less than or equal to −28° C. and even more preferentially less than or equal to −29° C. The present invention also relates to a composition of motor fuels and liquid hydrocarbon fuels having a settling volume according to the ARAL test of less than 10 mL and/or a delta CFPP before/after settling (according to the standard NF EN 116) less than or equal to 1° C. and/or a delta CP before/after settling (according to the standard NF EN 23015) less than or equal to 1° C.

According to the invention this purpose is achieved by an additive composition comprising:

- at least one modified alkylphenol-aldehyde resin capable of being obtained by Mannich reaction of an alkylphenol-aldehyde condensation resin
  - with at least one aldehyde and/or one ketone having 1 to 8 carbon atoms, preferably 1 to 4 carbon atoms;
  - and at least one hydrocarbon compound having at least one alkylmonoamine or alkylpolyamine group (alkylamine) having between 4 and 30 carbon atoms,
  - the alkylphenol-aldehyde condensation resin itself being able to be obtained by condensation
  - of at least one alkylphenol substituted by at least one linear or branched alkyl group having 1 to 30 carbon atoms, preferably a monoalkylphenol,
  - with at least one aldehyde and/or one ketone having 1 to 8 carbon atoms, preferably 1 to 4 carbon atoms, and
- at least one filterability additive chosen from:
  - the terpolymers of $C_4$ to $C_{22}$ alkyl (meth)acrylate, $C_{20}$ to $C_{24}$ alpha-olefin and maleimide N-substituted by a hydrocarbon chain having between 4 and 30 carbon atoms,
  - the homopolymers of $C_1$ to $C_{40}$ alkyl (meth)acrylate, preferably the $C_8$ to $C_{24}$ alkyl polyacrylates,
  - the ammonium salts of mono- or poly-carboxylic acid comprising at least one linear or branched, saturated or unsaturated hydrocarbon chain and having between 4 and 30 carbon atoms.

According to a preferred embodiment, the filterability additive is chosen from:

- the homopolymers of $C_1$ to $C_{40}$ alkyl (meth)acrylate, preferably the $C_8$ to $C_{24}$ alkyl polyacrylates,
- the ammonium salts of mono- or poly-carboxylic acid comprising at least one linear or branched, saturated or unsaturated hydrocarbon chain and having between 4 and 30 carbon atoms.

The subject of the invention also relates to an additive composition comprising:

- at least the modified alkylphenol-aldehyde resin,
- at least one first filterability additive chosen from the homopolymers of $C_1$ to $C_{40}$ alkyl (meth)acrylate, preferably the $C_8$ to $C_{24}$ alkyl polyacrylates and,
- at least one second filterability additive chosen from:
  - the terpolymers of $C_4$ to $C_{22}$ alkyl (meth)acrylate, $C_{20}$ to $C_{24}$ alpha-olefin and maleimide N-substituted by a hydrocarbon chain having between 4 and 30 carbon atoms,
  - the ammonium salts of mono- or poly-carboxylic acid comprising at least one linear or branched, saturated or unsaturated hydrocarbon chain and having between 4 and 30 carbon atoms.

According to a development, the ammonium salts are ammonium salts of mono- or poly-carboxylic acid comprising at least one linear or branched, saturated or unsaturated hydrocarbon chain and having between 4 and 30 carbon atoms and of fatty amine and/or of ethoxylated fatty amine. According to another development, the modified alkylphenol-aldehyde resin is capable of being obtained from at least one alkylphenol substituted in para position, preferably from p-nonylphenol.

In particular, the modified alkylphenol-aldehyde resin is capable of being obtained from at least one aldehyde and/or one ketone chosen from formaldehyde, acetaldehyde, propionaldehyde, butyraldehyde, 2-ethyl hexanal, benzaldehyde, acetone, and preferably from at least formaldehyde. According to a variant, the modified alkylphenol-aldehyde resin is capable of being obtained from at least one alkylamine having at least one primary amine group, and advantageously at least one compound of which all their amine groups are primary amines. According to another variant, the modified alkylphenol-aldehyde resin is capable of being obtained from p-nonylphenol, formaldehyde and at least one hydrocarbon compound having at least one alkylmonoamine or alkylpolyamine group.

In particular, the modified alkylphenol-aldehyde resin is capable of being obtained from at least one alkylamine with a fatty chain or from a mixture of alkylamines with a fatty chain and preferably from alkylamine(s) having a number of carbon atoms between 12 and 24, preferably between 12 and 22. According to a variant, the modified alkylphenol-aldehyde resin has a viscosity at 50° C. measured using a dynamic rheometer at a shear rate of 100 $s^{-1}$ on a solution of said resin diluted with 30% by mass of an aromatic solvent comprised between 1,000 and 10,000 mPa·s, preferably 1,500 and 6,000 mPa·s and advantageously between 2,500 and 5,000 mPa·s.

Another subject of the invention relates to an additive composition comprising in addition at least one additional filterability additive chosen from the copolymers and terpolymers of ethylene and of vinyl ester and/or of acrylic ester (EVA and/or EVP). According to a development, the additional filterability additive is chosen from the copolymers of ethylene and vinyl ester (EVA). Another subject of the invention also relates to the use of an additive composition according to the invention, in a motor fuel or a liquid hydrocarbon fuel comprising, preferably, at least one filterability additive chosen from the copolymers and terpolymers of ethylene and vinyl ester and/or acrylic ester, for improving the low temperature properties, in particular for reducing the cold filter-plugging point (CFPP) measured according to the standard NF EN 116, without affecting the effectiveness of the modified alkylphenol-aldehyde resin on the dispersion and/or the settling of waxes. Another subject of the invention relates to the use of a composition according to the invention, in motor fuels and liquid hydrocarbon fuels, for improving the low temperature properties of motor fuels and liquid hydrocarbon fuels.

In particular, the use of such a composition, for reducing both the cold filter-plugging point and the dispersion of waxes and/or for limiting the settling of waxes in motor fuels and liquid hydrocarbon fuels. According to a variant, the motor fuels and/or fuels have a boiling range from 120 to 500° C., preferably 140 to 400° C. and, advantageously, are chosen from jet fuels, gas oils, diesel fuels, domestic fuel oil and heavy fuel oil.

Finally, the present invention relates to a composition of motor fuels or liquid hydrocarbon fuels the boiling temperature range of which is mainly comprised between 100 and 500° C. comprising:

- a major proportion of hydrocarbon compounds and/or of vegetable and/or animal oils and/or their oil esters and/or of biodiesels of animal and/or vegetable origin, and
- a minor proportion, preferably comprised between 5 and 5,000 ppm by mass, of at least one composition according to the invention.

DETAILED DESCRIPTION

Other advantages and characteristics will become clearer from the following description of particular embodiments of the invention which are given as non-limitative examples.

According to a first particular embodiment, an additive composition comprises at least one modified alkylphenol-aldehyde resin and at least one filterability additive. By filterability additive is meant an additive facilitating nucleation, limiting the growth of wax crystals and thus improving the flow of motor fuels and liquid hydrocarbon fuels, in particular by reducing their cold filter-plugging point (CFPP). These filterability additives are also called CFPP additives or CFI (acronym for Cold Flow Improver) additive.

The modified alkylphenol-aldehyde resin is obtained by Mannich reaction of an alkylphenol-aldehyde condensation resin:

- with at least one aldehyde and/or one ketone having 1 to 8 carbon atoms, preferably 1 to 4 carbon atoms;
- and at least one hydrocarbon compound having at least one alkylmonoamine or alkylpolyamine group having between 4 and 30 carbon atoms, which hereinafter is called "alkylamine" for reasons of simplicity and clarity.

The alkylphenol-aldehyde condensation resin is itself obtained by condensation:

- of at least one alkylphenol substituted by at least one linear or branched alkyl group, having 1 to 30 carbon atoms, preferably a monoalkylphenol,
- with at least an aldehyde and/or a ketone having 1 to 8 carbon atoms, preferably 1 to 4 carbon atoms.

The modified alkylphenol-aldehyde resin according to the invention is, advantageously, obtained from at least one alkylphenol substituted in para position. Preferably, nonylphenol is used.

The average number of phenol rings per molecule of preferred nonylphenol-aldehyde resin is, preferably, greater than 6 and less than or equal to 25 and, more preferentially comprised between 8 and 17, and even more preferentially between 9 and 16, phenol rings per molecule. The number of phenol rings can be determined by nuclear magnetic resonance (NMR) or gel permeation chromatography (GPC). According to a variant, the modified alkylphenol-aldehyde resin can be obtained from at least one aldehyde and/or one ketone chosen from formaldehyde, acetaldehyde, propionaldehyde, butyraldehyde, 2-ethyl-hexanal, benzaldehyde, acetone, preferably at least formaldehyde.

According to a preferred variant, the modified alkylphenol-aldehyde resin is obtained from at least one alkylamine having at least one primary amine group. In particular, the modified alkylphenol-aldehyde resin can advantageously be obtained from at least one alkylamine having at least one primary amine group and at least one compound of which all the amine groups are primary amines. The alkylamine is, preferably, an alkylamine with a fatty chain having between 12 and 24 carbon atoms, preferably between 12 and 22 carbon atoms.

According to another preferred variant, the modified alkylphenol-aldehyde resin is obtained from at least one alkylamine having at least one primary amine group and comprising a fatty chain having between 12 and 24 carbon atoms, preferably between 12 and 20 carbon atoms. The commercially-available alkylamines are in general not pure compounds but mixtures. Among the commercially-available alkylamines which are suitable, there can in particular be mentioned the following alkylamines with an aliphatic chain marketed under the names: Noram®, Trinoram®, Duomeen®, Dinoram®, Trinoram®, Triameen®, Armeen®, Polyram®, Lilamin® and Cemulcat®. By way of preferred example, Trinoram S can be mentioned which is a tallow dipropylenetriamine, also known by the name N-(Tallow-alkyl)dipropylenetriamine. The viscosity of the modified alkylphenol-aldehyde condensation resin, diluted with 30% by mass of aromatic solvent measured at 50° C. using a dynamic rheometer with a shear rate of 100 $s^{-1}$ is preferably comprised between 1,000 and 10,000 mPa·s, preferably between 1,500 and 6,000 mPa·s, and advantageously between 2,500 and 5,000 mPa·s.

The filterability additive is chosen from:

- the terpolymers of $C_4$ to $C_{22}$, preferably $C_{18}$ to $C_{22}$, alkyl (meth)acrylate, $C_{20}$ to $C_{24}$ alpha-olefin and maleimide N-substituted by a hydrocarbon chain having between 4 and 30 carbon atoms, preferably between 14 and 20, more preferentially between 16 and 18 carbon atoms, it being understood that the closed N-substituted maleimide structure can also, depending on the conditions of use or storage, open in order to be presented as an amide/ammonium salt or open diamide structure,
- the homopolymers of $C_1$ to $C_{40}$ alkyl (meth)acrylate, preferably the $C_1$ to $C_{40}$, more preferentially $C_8$ to $C_{24}$, alkyl polyacrylates,
- the ammonium salts of mono- or poly-carboxylic acid comprising at least one linear or branched, saturated or unsaturated hydrocarbon chain and having between 4 and 30 carbon atoms.

The filterability additive is, for example, a random terpolymer of stearyl methacrylate, $C_{20}$-$C_{24}$ alpha-olefin and N-tallow maleimide (density at 15° C.: 890-930 kg/$m^3$—flash point: >55° C. (NF EN ISO 22719); spontaneous ignition temperature: approximately >450° C., marketed by Total Additifs & Carburants Speciaux under the name TP.

The filterability additive is, more preferentially chosen from:

- the homopolymers of $C_1$ to $C_{40}$ alkyl (meth)acrylate, preferably the $C_1$ to $C_{40}$, more preferentially $C_8$ to $C_{24}$, alkyl polyacrylates,
- the ammonium salts of mono- or poly-carboxylic acid comprising at least one linear or branched, saturated or unsaturated hydrocarbon chain and having between 4 and 30 carbon atoms.

The homopolymers of alkyl (meth)acrylate have, preferably, a weight average molecular weight Mw comprised between 5,000 and 20,000, preferably comprised between 7,000 and 19,000, even more preferentially between 10,000 and 19,000. The average molecular weight can be measured in a standard fashion with a viscosimetric detector or by calibration with a standard, for example methyl polymethacrylate or polystyrene.

The ammonium salts are, advantageously, ammonium salts of mono- or poly-carboxylic acid comprising at least one linear or branched, saturated or unsaturated hydrocarbon chain, having 4 to 30 carbon atoms, preferably 10 to 24 carbon atoms and of fatty amine and/or of ethoxylated fatty amine. The fatty amines can optionally be hydrogenated and/or contain one or more ethylene oxide (ethoxylated amine) units. The fatty amines generally have a saturated or unsaturated hydrocarbon chain length varying from 4 to 30 carbon atoms, optionally hydrogenated. By way of example, there can be mentioned the tallow fatty amines, mainly $C_{16}$-$C_{18}$, optionally hydrogenated and being able to contain 3 to 8 units of ethylene oxide, preferably 5 to 7 units of ethylene oxide. The modified alkylphenol-aldehyde resin: filterability additive mass ratio is comprised between 1:99 and 99:1, preferably between 90:10 and 10:90, more preferentially between 70:30 and 30:70.

The additive composition can also comprise one or more solvent or dispersing agents. By way of example, the solvent or dispersing agent is chosen from the aliphatic and/or aromatic hydrocarbons or mixtures of hydrocarbons, for example fractions of gasoline, kerosene, decane, pentadecane, toluene, xylene, and/or ethylbenzene and/or mixtures of commercial solvents such as Solvarex 10, Solvarex LN, Solvent Naphtha, Shellsol AB, Shellsol D, Solvesso 150, Solvesso 150 ND, Solvesso 200, Exxsol, ISOPAR.

The mass concentration of the modified alkylphenol-aldehyde resin in the additive composition can, advantageously, vary from 1 to 99.5%, preferably from 5 to 95%, more preferentially from 10 to 90% and even more preferentially from 30 to 90%. The mass concentration of the filterability additive in the additive composition can advantageously vary from 0.5 to 99%, preferably from 1 to 70% and, more preferentially, from 1 to 50% and more preferentially from 1 to 30%. Polar dissolution adjuvants, such as 2-ethylhexanol, decanol, isodecanol and/or isotridecanol can also be added to the additive composition. Apart from the additives mentioned above, namely the modified alkylphenol-aldehyde resins and the filtrability additive, other additives can also be added to the additive composition such as corrosion inhibiting agents, detergent additives, anti-clouding agents, additives improving the conductivity, colorants, reodorants, lubricity or lubricating additives, etc.

Among these other additives, there can be particularly mentioned:

a) the procetane additives, in particular (but not limitatively) chosen from the alkyl nitrates, preferably 2-ethyl hexyl nitrate, the aroyl peroxides, preferably benzyl peroxide, and alkyl peroxides, preferably ter-butyl peroxide;

b) the anti-foam additives, in particular (but not limitatively) chosen from the polysiloxanes, the oxyalkylated polysiloxanes, and the fatty acid amides originating from vegetable or animal oils; examples of such additives are given in EP0663000, EP0736590;

c) the detergent and/or anti-corrosion additives, in particular (but not limitatively) chosen from the group constituted by the amines, succinimides, alkenylsuccinimides, polyalkylamines, polyalkyl polyamines and polyetheramines, quaternary ammonium salts; examples of such additives are given in EP0938535; U.S. Patent Publication No. 2012/0010112 and WO2012/004300;

d) the lubricity additives or anti-wear agent, in particular (but not limitatively) chosen from the group constituted by the fatty acids and their ester or amide derivatives, in particular glycerol monooleate, and mono- and polycyclic carboxylic acid derivatives; examples of such additives are given in the following documents: EP0680506, EP0860494, WO1998/004656, EP0915944, FR2772783, FR2772784;

e) the cloud point additives, in particular (but not limitatively) chosen from the group constituted by the long-chain olefin/(meth)acrylic ester/maleimide terpolymers, and fumaric/maleic acid ester polymers. Examples of such additives are given in EP0071513, EP0100248, FR2528051, FR2528423, EP0112195, EP172758, EP0271385, EP0291367;

f) the anti-settling additives and/or wax dispersants in particular (but not limitatively) chosen from the group constituted by (meth)acrylic acid/polyamine-amidified alkyl (meth)acrylate copolymers, polyamine alkenylsuccinimides, the derivatives of phthalamic acid and of double-chain fatty amine; alkylphenol/aldehyde resins that differ from the alkylphenol/aldehyde resins according to the invention; examples of such additives are given in EP0261959, EP0593331, EP0674689, EP0327423, EP0512889, EP0832172, U.S. Patent Publication No. 2005/0223631, U.S. Pat. No. 5,998,530, WO1993/014178;

g) the cold operability multi-functional additives chosen in particular from the group constituted by the polymers based on olefin and alkenyl nitrate as described in EP0573490;

h) other additives improving the low-temperature behaviour and filterability (CFI), such as the ethylene/vinyl acetate (EVA) and/or ethylene/vinylpropionate (EVP) copolymers, the ethylene/vinyl acetate/vinyl versatate (E/VA/VEOVA) terpolymers; the amidified maleic anhydride/alkyl(meth)acrylate copolymers which can be obtained by the reaction of a maleic anhydride/alkyl (meth)acrylate and an alkylamine or polyalkylamine copolymer having a hydrocarbon chain from 4 to 30 carbon atoms, preferably, from 12 to 24 carbon atoms; the amidified alpha-olefin/maleic anhydride copolymers which can be obtained by the reaction of an alpha-olefin/maleic anhydride and an alkylamine or polyalkylamine copolymer, the alpha-olefin being able to be chosen from the $C_{12}$-$C_{40}$, preferably $C_{16}$-$C_{20}$, alpha-olefins and the alkylamine or polyalkylamine having, advantageously, a hydrocarbon chain of 4 to 30 carbon atoms, preferably 12 to 24 carbon atoms;

i) the anti-oxidants of hindered phenolic type or amines of alkylated paraphenylene diamine type;

j) the metal passivators, such as triazoles, alkylated benzotriazoles;

k) the metal sequestering agents such as disalicylidene propane diamine (DMD);

l) the acidity neutralizers such as cyclic alkylamines.

The additive compositions are, for example, prepared by solubilizing or by dispersing each constituent, separately or in a mixture, with one or more solvent or dispersing agents as described previously.

According to a second particular embodiment, the additive composition comprises:

at least the modified alkylphenol-aldehyde resin, at least one first filterability additive chosen from the homopolymers of $C_1$ to $C_{40}$ alkyl(meth)acrylate, preferably the $C_1$ to $C_{40}$, more preferentially $C_8$ to $C_{24}$, alkyl polyacrylates and, at least one second filterability additive chosen from:

the terpolymers of $C_4$ to $C_{22}$, preferably $C_{18}$ to $C_{22}$ alkyl (meth)acrylate, $C_{20}$ to $C_{24}$ alpha-olefin and maleimide N-substituted by a hydrocarbon chain having between 4 and 30, preferably between 14 and 20, more preferentially between 16 and 18 carbon atoms, it being understood that the closed N-substituted maleimide structure can also, depending on the conditions of use or storage, open in order to be presented as an open amide/ammonium salt structure, or contain a certain proportion of diamides depending on the operating conditions adopted, the ammonium salts of mono- or poly-carboxylic acid comprising at least one linear or branched, saturated or unsaturated hydrocarbon chain and having between 4 and 30 carbon atoms.

The second particular embodiment is identical to the first particular embodiment, with the exception that the composition comprises at least the first filterability additive and at least the second filterability additive. In particular, the modified alkylphenol-aldehyde resins, the terpolymers of alkyl (meth)acrylate and the ammonium salts are as described in the first particular embodiment.

The modified alkylphenol-aldehyde resin: first and second filterability additives mass ratio is advantageously comprised between 1:99 and 99:1, preferably between 10:90 and 90:10 and, more preferentially, between 30:70 and 70:30. In particular, the first filterability additive: second filterability additive mass ratio is advantageously comprised between 1:99 and 99:1, preferably between 10:90 and 90:10 and, more preferentially, between 70:30 and 30:70.

The mass concentration of the modified alkylphenol-aldehyde resin in the additive composition can advantageously vary from 1 to 99%, preferably, from 5 to 95%, more preferentially from 10 to 90% and even more preferentially from 30 to 90%. The mass concentration of the first filterability additive in the additive composition can advantageously vary from 0.5 to 99%, preferably, from 1 to 70% and, more preferentially from 1 to 50% and more preferentially from 1 to 30%. The mass concentration of the second filterability additive in the additive composition can advantageously vary from 0.5 to 99%, preferably, from 1 to 70%, more preferentially, from 1 to 50% and more preferentially from 1 to 30%.

The additive composition according to the first and second particular embodiments can be used in a motor fuel or a liquid hydrocarbon fuel comprising, preferably, at least one additional filterability additive chosen from the copolymers and the terpolymers of ethylene and vinyl and/or acrylic ester, for improving the low temperature properties, in particular the cold filter-plugging point (CFPP) measured according to the standard NF EN 116, without affecting the effectiveness of the modified alkylphenol-aldehyde resin on the dispersion and/or the settling of the waxes.

In these previous works (FR2010/61193 and PCT/IB2011/055863), the applicant had observed an anti-settling effect produced by the mixture of an additional filterability additive chosen from the copolymers and the terpolymers of ethylene and vinyl ester and/or acrylic ester with at least one modified alkylphenol-aldehyde resin as described above. The inventors have now demonstrated an additional CFPP effect called a "booster" effect due to the addition to the modified alkylphenol-aldehyde resin, of one or more filterability additive(s) selected as described above. This effect is all the more remarkable as it brings to said dispersant/modified resin additive mixture, an advantageous additional effect with respect to the CFPP, without affecting the anti-settling effect provided by the modified alkylphenol-aldehyde resin. This effect is not observed in the case of all the filterability additives. The dispersing activity of the waxes provided by the combination of the additional filterability additive and the modified alkylphenol-aldehyde resin is maintained in the additive compositions according to the first and second particular embodiments. Thus, the particular selection of the filterability additives makes it possible to reduce the CFPP and limit the settling of the crystallized waxes in a motor fuel or a liquid hydrocarbon fuel, at low temperature.

The additional filterability additive is, preferably, chosen from the copolymers or terpolymers of ethylene and vinyl acetate and/or vinyl propionate and/or vinyl versatate; ethylene and/or (alkyl)acrylates and/or (alkyl)methacrylates, it being understood that the alkyl group of the (alkyl)acrylates and (alkyl)methacrylates advantageously contains 1 to 40 carbon atoms, preferably 16 to 24 carbon atoms, alone or in a mixture. The copolymers and terpolymers of ethylene and vinyl ester and/or acrylic ester have, advantageously, weight average molecular weights $M_w$ varying from 1,000 to 20,000 g/mol, preferably from 2,000 to 10,000 g/mol. By way of examples of additional filterability additives of copolymer type, there can be mentioned the copolymers of ethylene and vinyl acetate (EVA) having, preferably, weight average molecular weights $M_w$ varying from 1,000 to 20,000 g/mol, preferably from 2,000 to 10,000 g/mol. By way of examples of terpolymers, there can be mentioned those which are described in EP 1 692 196, WO09/106743 and WO09/106744. The additional filterability additive can be present in the motor fuel or liquid hydrocarbon fuel in a quantity ranging advantageously from 1 to 1,000 ppm, preferably from 5 to 500 ppm, more preferentially from 5 to 150 ppm and even more preferentially from 5 to 135 ppm.

According to a third particular embodiment of the invention, the additive composition as described previously in the first and second embodiments comprises in addition at least one filterability dispersant for improving the low temperature flow, in particular, an additional filterability additive chosen from the copolymers and terpolymers of ethylene and vinyl ester and/or acrylic ester. The additional filterability additive is as described above. The additive composition according to the third embodiment can be used in motor fuels and liquid hydrocarbon fuels, for improving the low temperature properties of motor fuels and liquid hydrocarbon fuels, in particular, as described above. The additive composition according to the third embodiment is particularly suitable for reducing both the cold filter-plugging point (CFPP) and the dispersion of waxes and/or limiting the settling of waxes in motor fuels and liquid hydrocarbon fuels.

The additive composition according to the third embodiment can be used as additives for improving the low temperature properties of fuel oils and oil distillates of petroleum origin and/or of renewable origin, and more particularly of the middle distillates the boiling temperature range of which is mainly comprised between 100 and 500° C. The middle distillates covered by the invention have in particular a CFPP according to the standard EN 116 comprised between −30° C. and +15° C., preferably between −30° C. and 0° C. and more preferentially between −30° C. and −20° C. This additive composition is particularly effective for the motor fuels and/or fuels which have a boiling range from 120 to 500° C., preferably from 140 to 400° C., and advantageously, chosen from jet fuels, gas oils, diesel fuels, domestic fuel oil and heavy fuel oil.

Another subject of the invention relates to a composition of motor fuels or liquid hydrocarbon fuels the boiling temperature range of which is mainly comprised between 100 and 500° C., preferably between 120 to 500° C., more preferentially from 140 to 400° C., and advantageously, chosen from jet fuels, gas oils, diesel fuels, domestic fuel oil and heavy fuel oil.

The composition of motor fuels or liquid hydrocarbon fuels comprises:

- a major proportion of hydrocarbon compounds and/or of vegetable and/or animal oils and/or their oil esters and/or of biodiesels of animal and/or vegetable origin, and
- a minor proportion of at least one composition as described in any one of the particular embodiments described previously.

By major proportion is meant a mass proportion advantageously greater than or equal to 97%, preferably greater than or equal to 98%, more preferentially greater than or equal to 99%. By minor proportion is meant a proportion advantageously comprised between 5 and 5,000 ppm by mass, preferably between 5 and 1,000 ppm, more preferentially between 50 and 3,000 ppm and even more preferentially between 5 and 500 ppm. Advantageously, the composition of motor fuels or liquid hydrocarbon fuels comprises a minor proportion of at least one composition as described in the third embodiment, i.e. with the additional filterability additive.

The modified alkylphenol-aldehyde resin is advantageously present in the motor fuel or liquid hydrocarbon fuel in a quantity ranging from 0.5 to 2,000 ppm, preferably from 0.5 to 500 ppm, more preferentially from 0.5 to 100 ppm, even more preferentially from 1 to 70 ppm. The filterability additive or the first and second filterability additives are advantageously present in the motor fuel or liquid hydrocarbon fuel in a quantity ranging, respectively, from 0.5 to 2,000 ppm, preferably from 0.5 to 500 ppm, more preferentially from 0.5 to 100 ppm and even more preferentially from 1 to 70 ppm. The additional filterability additive is advantageously present in the motor fuel or liquid hydrocarbon fuel in a quantity ranging from 1 to 1,000 ppm, preferably from 50 to 500 ppm, more preferentially from 100 to 400 ppm and even more preferentially from 50 to 400 ppm. Each of the other additives described above can be present in the motor fuel or liquid hydrocarbon fuel in a quantity ranging from 0.5 to 1,000 ppm, preferably from 1 to 500 ppm, even more preferentially from 1 to 400 ppm. The incipient crystallization temperature ICT of the motor fuel or liquid hydrocarbon fuel measured by Differential Scanning calorimetry is often greater than or equal to −20° C., in general comprised between −15° C. and +10° C.

These distillates can for example be chosen from the distillates obtained by direct distillation of crude hydrocarbons, the distillates from vacuum distillation, hydrotreated distillates, distillates originating from catalytic cracking and/or hydrocracking of distillates under vacuum, distillates resulting from conversion processes of ARDS (atmospheric residue desulphuration) type and/or visbreaking, distillates originating from upgrading of Fischer-Tropsch cuts, distillates resulting from BTL (biomass to liquid) conversion of vegetable and/or animal biomass, and/or mixtures thereof. The motor fuels and liquid hydrocarbon fuels can also contain distillates originating from refining operations which are more complex than those originating from the direct distillation of the hydrocarbons. The distillates can for example originate from cracking, hydrocracking and/or catalytic cracking processes and visbreaking processes.

The motor fuels and liquid fuels can also contain new sources of distillates, among which there can in particular be mentioned:

- the heaviest cuts originating from the cracking and visbreaking processes with a high concentration of heavy paraffins, comprising more than 18 carbon atoms,
- synthetic distillates originating from the conversion of gas such as those originating from the Fischer Tropsch process,
- synthetic distillates resulting from the treatment of biomass of vegetable and/or animal origin, such as in particular NExBTL,
- and the vegetable and/or animal oils and/or their esters such as methyl or ethyl esters of vegetable oils (MEVO, EEVO),
- hydrotreated and/or hydrocracked and/or hydrodeoxygenated (HDO) vegetable and/or animal oils,
- or also biodiesels of animal and/or vegetable origin.

These new motor fuel and fuel bases can be used alone or in a mixture with standard petroleum middle distillates as a motor fuel base and/or domestic fuel oil base. They generally comprise long paraffin chains greater than or equal to 10 carbon atoms and preferably $C_{14}$ to $C_{30}$. In general, the sulphur content of the compositions of motor fuels and liquid fuels is less than 5,000 ppm, preferably less than 500 ppm, and more preferentially less than 50 ppm, or even less than 10 ppm and advantageously with no sulphur, in particular for the motor fuels of gas oil type.

EXAMPLES

Example 1

Synthesis of Modified Alkylphenol-Aldehyde Resins by a Mannich Reaction

In a first stage, several alkylphenol-aldehyde resins are prepared by condensation of para-nonylphenol and formaldehyde (for example according to the operating method described in EP 857 776) with viscosities at 50° C. (measured at 50° C. using a dynamic rheometer with a shear rate of 10 $s^{-1}$) on the resin diluted with 30% by mass of aromatic solvent (Solvesso 150) comprised between 1,800 and 4,800 mPa·s. In a second stage, the alkylphenol-aldehyde resins originating from the first stage are modified by a Mannich reaction by the addition of formol and primary alkyl (poly) amine (for example an alkylpolyamine having a C12 alkyl chain (marketed under the name Noram® C) for the resin (1 A).

The characteristics of the resins obtained are shown in Table 1 below: alkylamine used, amount of dry material, viscosity at 50° C. (measured on resin diluted with 30% by mass of Solvesso 150, shear rate 10 $s^{-1}$).

TABLE 1

| Resin No. | Alkylamine used | Dry material (1 g-30 min-200° C.) | Viscosity at 50° C. (mPa · s) | Average number of phenol rings per molecule of resin |
|---|---|---|---|---|
| 1A | Noram C | 72.2% | 3700 | 8.0 |
| 2A | Trinoram S | 70.30% | 3675 | 4.1 |
| 2B | Trinoram S | 70.20% | 1950 | 1.4 |
| 2C | Trinoram S | 70.10% | 4855 | 14.1 |
| 2D | Trinoram S | 69.80% | 4590 | 16.5 |
| 2E | Trinoram S | 69.00% | 3180 | 10.1 |
| 2F | Trinoram S | 70.10% | 4990 | 15.5 |
| 3A | Noram SH | 72.80% | 2485 | 3.7 |

Example 2

ARAL Settling Tests

Each of the modified alkylphenol-aldehyde resins of Example 1 are evaluated as anti-settling additive or WASA alone (i.e. not combined with another WASA dispersing constituent) in an engine gas oil (EGO 1) to which is added 300 ppm by mass of a CFPP additive which is an EVA in solution at 70% by mass in an aromatic solvent (Solvesso 150 type) marketed under the name CP7936C. Each modified alkylphenol resin is incorporated in the gas oil at a concentration of 70 ppm by mass (the resin being dissolved with 30% by mass of solvent, 100 ppm by mass of solution at 70% of active substance is used).

By way of comparison, the gas oil EGO 1 to which is added 300 ppm of the CFPP additive described previously and the unmodified alkylphenol-aldehyde resin (comparative resin 1 with a viscosity measured at 50° C. using a dynamic rheometer diluted with 30% by mass Solvesso 150 equal to 2,000 mPa·s) are also evaluated. The anti-settling properties of the additives are evaluated by the following ARAL settling test: 500 mL of middle distillate additives are cooled in a 500 mL test tube in a climatic chamber to −13° C. according to the following temperature cycle: passing from +10° C. to −13° C. in 4 h then isothermal at −13° C. for 16 h. At the end of the test, a visual score of the appearance of the sample and the volume of the settled phase is carried out, then the 20% constituting the volume at the bottom is taken out, for determination of the cloud point CP (NF EN 23015) and CFPP (NF EN 116). Then the difference in the CP and CFPP is compared before and after settling (i.e. on the 20% volume at the bottom of the test tube), the lower the difference, the better the performance of the CP, CFPP property measured.

The results are shown in Table 2 below.

TABLE 2

| Added resin No. | Volume of sediments (mL per 500 mL of sample) | Visual score | CFPP measurement (° C.) NF EN 116 Before | After | Difference | CP measurement (° C.) NF EN 23015 Before | After | Difference |
|---|---|---|---|---|---|---|---|---|
| — | | | −16 | | | | | |
| Comparative Resin 1 | 115 | slightly cloudy | −16 | −4 | −12 | −6 | 4 | −10 |
| Resin 1A | 90 | cloudy | −18 | −9 | −9 | −5 | 0 | −5 |
| Resin 2A | 35 | cloudy | −19 | −10 | −9 | −6 | −2 | −4 |
| Resin 2B | 50 | cloudy | −19 | −13 | −6 | −6 | −2 | −4 |
| Resin 2C | 0 | homogeneous | −18 | −19 | 1 | −6 | −6 | 0 |
| Resin 3A | 105 | slightly cloudy | −18 | −4 | −14 | −6 | 3 | −9 |

It is noted that the unmodified standard alkylphenol resin (comparative resin 1) is not effective as regards anti-settling when it is used alone (i.e. without the addition of dispersant) whereas the modified alkylphenol resins according to the invention are, the most effective being the resin 2C, containing tallow dipropylenetriamine, particularly preferred.

New ARAL settling tests are carried out with the same gas oil for which the additivation rate of CFPP additive is unchanged (300 ppm) but for which the additivation rate of modified alklphenol-aldehyde resin (resin 2C) is different; once again, the modified alkylphenol-aldehyde resin is added in a solution concentrated at 70% by mass of active substance (resin) in 30% of solvent. By way of comparison, the gas oil EGO 1 to which is added 300 ppm of the CFPP additive described previously and an unmodified alkylphenol-aldehyde resin (comparative resin 1) combined with a nitrogenous polar dispersant of amidified dodecenylsuccinic anhydride type with a tallow dipropylenetriamine.

The mixture of additives contains 20% by mass of resin 1 and 80% by mass of amidified polar dodecenylsuccinic anhydride dispersant with a tallow dipropylenetriamine. The results are shown in Table 3 below.

TABLE 3

| WASA additive(s) used | Resin added (ppm of solution at 70% m of active substance) | | Test tube visual score (volume of sediments in mL per 500 mL of sample) | CFPP measurement (° C.) NF EN 116 Before | After | Difference | CP measurement (° C.) NF EN 23015 Before | After | Difference |
|---|---|---|---|---|---|---|---|---|---|
| No WASA | 0 | | | −16 | | | | | |
| Resin 2C | 75 | <5 | Homogeneous | −20 | −17 | −3 | −6 | −6 | 0 |
| Comparative | 75 | <10 | Homogeneous | −18 | −17 | −1 | −7 | −6 | −1 |

TABLE 3-continued

| WASA additive(s) used | Resin added (ppm of solution at 70% m of active substance) | Test tube visual score (volume of sediments in mL per 500 mL of sample) | CFPP measurement (° C.) NF EN 116 | | | CP measurement (° C.) NF EN 23015 | | |
|---|---|---|---|---|---|---|---|---|
| | | | Before | After | Difference | Before | After | Difference |
| Resin 1 + dispersant | | | | | | | | |
| Resin 2C | 50 | 10 | −19 | −17 | −2 | −6 | −6 | 0 |
| Comparative Resin 1 + dispersant | 50 | <10 Homogeneous | −20 | −19 | −1 | −7 | −6 | −1 |
| Resin 2C | 25 | 10 Homogeneous | −18 | −18 | 0 | −6 | −6 | 0 |
| Comparative Resin 1 + dispersant | 25 | 125 Cloudy at the bottom | −18 | −9 | −9 | −6 | 1 | −7 |
| Resin 2C | 15 | 15 Homogeneous | −18 | −19 | 1 | −6 | −5 | −1 |
| Comparative Resin 1 + dispersant | 15 | 115 Cloudy at the bottom | −16 | −7 | −9 | −6 | 1 | −7 |

These results relating to the effectiveness of anti-settling as a function of concentration (of active substance) show that the modified alkylphenol resin 2C according to the invention is more effective than the combination of standard alkylphenol resin+dispersant (polar nitrogenous compound) below 50 ppm of active substance.

New ARAL settling tests are carried out with the resin 2C in 2 other engine gas oils (EGO 2 (gas oil of type B5, i.e. containing 5% by volume of MEVO) and EGO 3 (gas oil of type B0 without MEVO) to which is added 300 ppm of the CFPP additive described previously. The characteristics of the engine gas oils EGO 2 and EGO 3 are shown in Table 6 below. By way of comparison, the anti-settling effectiveness of an unmodified alkylphenol-aldehyde resin (comparative resin 1) combined with a polar nitrogenous compound dispersant of dodecenylsuccinic anhydride type with a tallow dipropylenetriamine is evaluated; the results are shown in Tables 4 (tests in EGO 2) and 5 (tests in EGO 3).

TABLE 4 evaluation in EGO 2

| WASA additive(s) used | Resin added (ppm of solution at 70% m of active substance) | 500 mL test tube visual score | CFPP measurement (° C.) NF EN 116 | | | CP measurement (° C.) NF EN 23015 | | |
|---|---|---|---|---|---|---|---|---|
| | | | Before | After | Difference | Before | After | Difference |
| Comparative Resin 1 + dispersant | 112.5 | 100 | −27 | −10 | 17 | −4 | 1 | 5 |
| Resin 2C | 112.5 | <5 | −21* | −16 | 5 | −4 | −4 | 0 |

*hard point at −16° C.

TABLE 5 evaluation in EGO 3

| WASA additive(s) used | Resin added (ppm of solution to 70% m of active substance) | 500 mL test tube visual score | CFPP measurement (° C.) NF EN 116 | | | CP measurement (° C.) NF EN 23015 | | |
|---|---|---|---|---|---|---|---|---|
| | | | Before | After | Difference | Before | After | Difference |
| Comparative Resin 1 + dispersant | 100 | 0 | −19 | −19 | 0 | −7 | −7 | 0 |
| Resin 2C | 100 | <5 | −19 | −18 | 1 | −7 | −7 | 0 |

TABLE 6

| EGO | EGO 1 | EGO 2 | EGO 3 |
|---|---|---|---|
| Total waxes (% mass) | 14.72 | 12.95 | 13.56 |
| CFPP (° C.) NF EN 116 | −6 | −5 | −7 |
| PP (° C.) NF-T60-105 | −15 | −12 | −12 |
| CP (° C.) NF EN 23015 | −7 | −5 | −5 |
| MV15 (kg/m$^3$) NF EN ISO12185 | 826.5 | 829.23 | 824.77 |
| Sulphur content (mg/kg) | 18.6 | 7.80 | 7.10 |
| Mono aromatics (% mass) NF EN 12916 | 19 | 15.7 | 15.7 |
| Di aromatics (% mass) NF EN 12916 | 4 | 2 | 1.8 |
| Tri aromatics (% mass) NF EN 12916 | 0.3 | 0.5 | 0.5 |
| Total aromatics (% mass) NF EN 12916 | 23.3 | 18.2 | 18 |
| Poly aromatics (% mass) NF EN 12916 | 4.3 | 2.5 | 2.3 |
| Distillation ASTM D86 (° C.) | | | |
| 0% | 157.2 | 158.6 | 161.5 |
| 5% | 178.7 | 183.7 | 183.9 |
| 10% | 186.9 | 194 | 193.3 |
| 20% | 207.9 | 215.4 | 211.9 |
| 30% | 229.9 | 236.1 | 229.7 |
| 40% | 250.1 | 255.60 | 248.1 |
| 50% | 266.9 | 273.6 | 264 |
| 60% | 282 | 289.1 | 277.9 |
| 70% | 298.1 | 303.7 | 291.1 |
| 80% | 315.5 | 319.5 | 306.7 |
| 90% | 337.5 | 337.1 | 326.9 |
| 95% | 353.5 | 350 | 343.6 |
| 100% | 356.9 | 358.6 | 354.5 |
| MEVO content (% vol) | 0 | 5 | 0 |

at 15° C.: 890-930 kg/m$^3$—flash point: >55° C. (NF EN ISO 22719); spontaneous ignition temperature: approximately >450° C.;

an ammonium salt, called "SA" obtained by the reaction of a polycarboxylic acid of tall oil (important by-product of the kraft pulping of conifers, and particularly of pine) mainly C18, modified with a maleic anhydride marketed under the name TENAX®2012 by the company Meadwestvaco Corporation and a di(hydrogenated tallow) amine marketed under the name Noram 2SH or Duomeen T, alkylpolyamine having a hydrogenated C16-C18 alkyl chain.

Solvent aromatic solvent of Solvesso 150 type.

Synthesis of Additive Compositions $T_1$ and $T_2$, $A^0_1$ to $A^0_3$ and $A_1$ to $A_6$ Additive compositions referenced $A_1$ to $A_6$ as well as five control additive compositions $T_1$ and $T_2$ and $A^0_1$ to $A^0_3$ are obtained either by mixing the unmodified alkylphenol-aldehyde resin Resin 1 in the solvent or the modified alkylphenol-aldehyde resin Resin 2C in the solvent and, optionally, one or more filterability additives according to the proportions defined in Table 7.

TABLE 7

| | Mass concentration (%) | | | | | Mass ratio | |
|---|---|---|---|---|---|---|---|
| Ref. | Resin 2C | Resin 1 (comparative) | PA | TP | SA | Resin:PA:TP:SA | PA:TP:SA |
| $T_1$ | 0 | 20 | 0 | 0 | 0 | 100:0:0:0 | — |
| $A_1^0$ | 0 | 20 | 6 | 0 | 0 | 76.9:23.1:0:0 | 100:0:0 |
| $A_2^0$ | 0 | 20 | 3 | 5 | 0 | 71.4:10.7:17.9:0 | 37.5:62.5:0 |
| $A_3^0$ | 0 | 20 | 0 | 0 | 10 | 66.7:0:0:33.3 | 0:0:100 |
| $T_2$ | 20 | 0 | 0 | 0 | 0 | 100:0:0:0 | — |
| $A_1$ | 20 | 0 | 6 | 0 | 0 | 76.9:23.1:0:0 | 100:0:0 |
| $A_2$ | 20 | 0 | 3 | 5 | 0 | 71.4:10.7:17.9:0 | 37.5:62.5:0 |
| $A_3$ | 20 | 0 | 0 | 0 | 10 | 66.7:0:0:33.3 | 0:0:100 |
| $A_4$ | 16 | 0 | 13.3 | 0 | 0 | 54.5:45.5:0:0 | 100:0:0 |
| $A_5$ | 16 | 0 | 10 | 10 | 0 | 44.4:27.8:27.8:0 | 50:50:0 |
| $A_6$ | 10 | 0 | 10 | 10 | 0 | 33.3:33.3:33.3:0 | 50:50:0 |

Example 3

Synthesis of Motor Fuel or Liquid Hydrocarbon Fuel Compositions

Starting Constituents:

Alkylphenol-Aldehyde Resin

Comparative Resin 1 and a Resin 2C as synthesized in Example 1

Filterability Additive $C_{12}/C_{14}$ alkyl polyacrylate, called "PA", having a weight average molecular weight Mw of 7,000 g/mol measured with a viscosimetric detector and 13,000 g/mol per calibration with methyl polymethacrylate, a random terpolymer called "TP", of stearyl methacrylate, $C_{20}$-$C_{24}$ alpha-olefin and N-tallow maleimide (density Synthesis of Motor Fuel or Liquid Hydrocarbon Fuel Compositions $C_0$, $C_{T1}$ to $C_{T5}$ and $C_1$ to $C_6$ A control composition $C_0$ is obtained from an engine gas oil EGO 4 to which is added 300 ppm by mass of an additional filterability additive which is a mixture of copolymers of ethylene/vinyl acetate (EVA) in solution at 70% by mass in an aromatic solvent Solvesso 150, called EVA1, marketed by the company Total Additifs & Carburants Speciaux under the name CP7870C.

Motor fuel or liquid hydrocarbon fuel compositions $C_1$ to $C_6$ as well as five control compositions $C_{T1}$ and $C_{T5}$ are obtained from an engine gas oil EGO 4 or 5 to which is added 300 ppm by mass of an additional filterability additive EVA1 and an additive composition chosen from $T_1$, $T_2$, $A^0_1$, $A^0_2$, $A^0_3$, or $A_1$ to $A_6$.

Each additive composition $T_1$, $T_2$, $A^0_1$, $A^0_2$, $A^0_3$, or $A_1$ to $A_6$ is incorporated in the engine gas oil EGO 4 or 5 in a quantity of 150 ppm by mass. The characteristics of the engine gas oils EGO 4 and 5 are shown in Table 8 which follows:

TABLE 8

| EGO | | EGO 4 | EGO 5 |
|---|---|---|---|
| CFPP (° C.) NF EN 116 | | −8 | −8 |
| CP (° C.) NF EN 23015 | | −7 | −7 |
| MV15 (kg/m$^3$) NF EN ISO12185 | | 835.6 | 840.4 |
| Sulphur content (mg/kg) | | 10 | 10 |
| monoaromatics | | 12 | 14.3 |
| diaromatics | | 1.2 | 2.7 |
| triaromatics | | 0.3 | 0.2 |
| polyaromatics | | 0.1 | 0.03 |
| Total n-paraffins (% m/m) | | 13.6 | 11.9 |
| Distribution | $<nC_{13}$ (% m/m) | 4.8 | 3.9 |
| of the | $nC_{13}$-$nC_{17}$ (% m/m) | 5.7 | 4.7 |
| n-paraffins | $nC_{18}$-$nC_{23}$ (% m/m) | 2.7 | 3 |
| | $>nC_{13}$ (% m/m) | 0.4 | 0.3 |
| MEVO content (% vol) | | 7 | 7 |

ARAL Settling Tests

The anti-settling properties of the additive compositions are evaluated for each of the motor fuel or liquid hydrocarbon fuel compositions $C_1$ to $C_6$ as well as for the six control compositions $C_0$, $C_{T1}$ to $C_{T5}$, according to an ARAL settling test identical to that of Example 2.

The results of the ARAL tests are shown in Table 9 which follows:

TABLE 9

| Ref. | Additive composition | EGO ref. | Volume of sediments (in mL per 500 mL of sample) | Visual score | CFPP measurement (° C.) NF EN 116 Before | CFPP After | CP measurement (° C.) NF EN 23015 Before | CP After |
|---|---|---|---|---|---|---|---|---|
| $C_0$ control EVA alone | | EGO 4 | 150 | clear with sediments | −21 | −16 | −8 | 0 |
| $C_{T1}$ | $T_1$ | EGO 4 | 160 | clear with sediments | −20 | −16 | −8 | −2 |
| $C_{T2}$ | $A^0_1$ | EGO 4 | 80 | clear with sediments | −24 | −18 | −7 | −3 |
| $C_{T3}$ | $A^0_2$ | EGO 4 | 60 | clear with sediments | −27 | −15 | −8 | −1 |
| $C_{T4}$ | $A^0_3$ | EGO 4 | 90 | clear with sediments | −28 | −17 | −8 | −1 |
| $C_{T5}$ | $T_2$ | EGO 4 | 25 | Cloudy | −25 | −27 | −8 | −7 |
| $C_1$ | $A_1$ | EGO 4 | <10 | homogeneously cloudy | −30 | −29 | −7 | −8 |
| $C_2$ | $A_2$ | EGO 4 | <10 | homogeneously cloudy | −28 | −28 | −8 | −8 |
| $C_3$ | $A_3$ | EGO 5 | <10 | homogeneously cloudy | −29 | −29 | −8 | −8 |
| $C_4$ | $A_4$ | EGO 5 | <10 | homogeneously cloudy | −28 | −28 | −7 | −8 |
| $C_5$ | $A_5$ | EGO 5 | <10 | homogeneously cloudy | −28 | −28 | −8 | −8 |
| $C_6$ | $A_6$ | EGO 5 | <10 | homogeneously cloudy | −29 | −29 | −8 | −8 |

The test on the control composition $C_0$ makes it possible to evaluate the effect on the settling and the CFPP of the additional filterability additive EVA1 alone. The test on the control composition $C_{T5}$ makes it possible to evaluate the effect on the settling and the CFPP of the additional filterability additive EVA1 in combination with a modified alkylphenol-aldehyde resin (Resin 2C) compared with the test on the control composition $C_{T1}$ carried out with the unmodified resin (Resin 1). The tests on the control compositions $C_1$ to $C_6$ make it possible to evaluate the effect on the settling and the CFPP of the additional filterability additive EVA1 in combination with a modified alkylphenol-aldehyde resin (Resin 2C) formulated with the filterability additives PA, TP and/or SA compared with the tests on the control compositions $C_{T2}$ to $C_{T4}$, carried out with the unmodified resin (Resin 1).

It is noted that the compositions $C_1$ to $C_6$ have a lower CFPP and improved anti-settling properties compared with the compositions $C_O$, $C_{T1}$ and $C_{T5}$. A combined effect on the CFPP and the anti-settling performance, with a CFPP reaching −30° C. ($C_1$), a CFPP and/or CP difference before/after settling of a maximum of 0 or 1° C. are observed. The addition of the filterability additive, PA, TP or SA to the modified alkylphenol-aldehyde resin (Resin 2C) makes it possible to lower the CFPP by an additional approximately 5° C. with respect to the CFPP of the composition $C_{T5}$, without affecting the anti-settling performance provided by the modified alkylphenol-aldehyde resin (Resin 2C). A CFPP booster effect together with an improvement in the anti-settling properties is thus observed when the additive compositions $A_1$ to $A_6$ according to the invention are used in a motor fuel or a liquid hydrocarbon fuel containing EVA1.

The invention claimed is:

1. An additive composition comprising:

(a) at least one modified alkylphenol-aldehyde resin obtained by Mannich reaction of an alkylphenol-aldehyde condensation resin:

(i) with at least one aldehyde and/or one ketone having 1 to 8 carbon atoms; and (ii) at least one hydrocarbon compound having at least one alkylmonoamine or alkylpolyamine group, having between 4 and 30 carbon atoms;

the alkylphenol-aldehyde condensation resin being itself obtained by condensation:

(iii) of at least one alkylphenol substituted by at least one linear or branched alkyl group, having 1 to 30 carbon atoms;

(iv) with at least one aldehyde and/or one ketone having 1 to 8 carbon atoms and;

(b) at least one filterability additive chosen from:

(i) terpolymers of $C_4$ to $C_{22}$ alkyl (meth)acrylate, $C_{20}$ to $C_{24}$ alpha-olefin and maleimide N-substituted by a hydrocarbon chain having between 4 and 30 carbon atoms;

(ii) the homopolymers of $C_1$ to $C_{40}$ alkyl (meth)acrylate;

(iii) the ammonium salts of mono- or poly-carboxylic acid comprising at least one linear or branched, saturated or unsaturated hydrocarbon chain and having between 4 and 30 carbon atoms.

2. The additive composition according to claim 1, comprising:

(a) at least one modified alkylphenol-aldehyde resin obtained by Mannich reaction of an alkylphenol-aldehyde condensation resin:

(i) with at least one aldehyde and/or one ketone having 1 to 8 carbon atoms; and (ii) at least one hydrocarbon compound having at least one alkylmonoamine or alkylpolyamine group, having between 4 and 30 carbon atoms;

The alkylphenol-aldehyde condensation resin itself being obtained by condensation:

(iii) of at least one alkylphenol substituted by at least one linear or branched alkyl group, having 1 to 30 carbon atoms; and (iv) with at least one aldehyde and/or one ketone having 1 to 8 carbon atoms, and;

(b) at least one filterability additive chosen from:

(i) the homopolymers of $C_1$ to $C_{40}$ alkyl (meth)acrylate;

(ii) ammonium salts of mono- or poly-carboxylic acid comprising at least one linear or branched, saturated or unsaturated hydrocarbon chain and having between 4 and 30 carbon atoms.

3. The additive composition according to claim 1, comprising:

(a) at least the modified alkylphenol-aldehyde resin;

(b) at least one first filterability additive chosen from the homopolymers of $C_1$ to $C_{40}$ alkyl (meth)acrylate; and (c) at least one second filterability additive chosen from:

(i) the terpolymers of $C_4$ to $C_{22}$ alkyl (meth)acrylate, $C_{20}$ to $C_{24}$ alpha-olefin and maleimide N-substituted by a hydrocarbon chain having between 4 and 30 carbon atoms;

(ii) the ammonium salts of mono- or poly-carboxylic acid comprising at least one linear or branched, saturated or unsaturated hydrocarbon chain and having between 4 and 30 carbon atoms.

4. The additive composition according to claim 1, in which the ammonium salts are the ammonium salts of mono- or poly-carboxylic acid comprising at least one linear or branched, saturated or unsaturated hydrocarbon chain, having between 4 and 30 carbon atoms, and of fatty amine and/or of ethoxylated fatty amine.

5. The additive composition according to claim 1, in which the modified alkylphenol-aldehyde resin is obtained from at least one alkylphenol substituted in para position.

6. The additive composition according to claim 1, in which the modified alkylphenol-aldehyde resin is obtained from at least one aldehyde and/or one ketone chosen from formaldehyde, acetaldehyde, propionaldehyde, butyraldehyde, 2-ethyl hexanal, benzaldehyde, or acetone.

7. The additive composition according to claim 1, in which the modified alkylphenol-aldehyde resin is obtained from at least one alkylamine having at least one primary amine group.

8. The additive composition according to claim 1, in which the modified alkylphenol-aldehyde resin is obtained from p-nonylphenol, formaldehyde and at least one hydrocarbon compound having at least one alkylmonoamine or alkylpolyamine group.

9. The additive composition according to claim 1, in which the modified alkylphenol-aldehyde resin is obtained from at least one alkylamine with a fatty chain or of a mixture of alkylamines with a fatty chain.

10. The additive composition according to claim 1, in which the modified alkylphenol-aldehyde resin has a viscosity at 50° C. measured using a dynamic rheometer at a shear rate of 100 $s^{-1}$ on a solution of said resin diluted with 30% by mass of an aromatic solvent comprised between 1,000 and 10,000 mPa·s.

11. The additive composition according to claim 1, comprising in addition at least one additional filterability additive chosen from the copolymers and terpolymers of ethylene and vinyl ester and/or acrylic ester (EVA and/or EVP).

12. The additive composition according to claim 11, in which the additional filterability additive is chosen from the copolymers of ethylene and vinyl ester (EVA).

13. A method for improving low temperature properties, the method comprising reducing cold filter-plugging point (CFPP) measured according to the standard NF EN 116, without affecting an effectiveness of a modified alkylphenol-aldehyde resin on a dispersion and/or setting of waxes, the method further comprising adding an additive composition in a motor fuel or a liquid hydrocarbon fuel, the additive composition comprising:

(a) at least one modified alkylphenol-aldehyde resin obtained by Mannich reaction of an alkylphenol-aldehyde condensation resin:

(i) with at least one aldehyde and/or one ketone having 1 to 8 carbon atoms; and (ii) at least one hydrocarbon compound having at least one alkylmonoamine or alkylpolyamine group, having between 4 and 30 carbon atoms;

the alkylphenol-aldehyde condensation resin being itself obtained by condensation:

(iii) of at least one alkylphenol substituted by at least one linear or branched alkyl group, having 1 to 30 carbon atoms;

(iv) with at least one aldehyde and/or one ketone having 1 to 8 carbon atoms; and (b) at least one filterability additive chosen from:

(i) terpolymers of $C_4$ to $C_{22}$ alkyl (meth)acrylate, $C_{20}$ to $C_{24}$ alpha-olefin and maleimide N-substituted by a hydrocarbon chain having between 4 and 30 carbon atoms;

(ii) the homopolymers of $C_1$ to $C_{40}$ alkyl (meth)acrylate;

(iii) the ammonium salts of mono- or poly-carboxylic acid comprising at least one linear or branched, saturated or unsaturated hydrocarbon chain and having between 4 and 30 carbon atoms;.

14. A method for improving low temperature properties of motor fuels or liquid hydrocarbon fuels, the method comprising adding a composition as defined in claim 11, in the motor fuels or liquid hydrocarbon fuels.

15. The method according to claim 14, for reducing both the cold filter-plugging point and the dispersion of waxes and/or limiting the settling of waxes in motor fuels and liquid hydrocarbon fuels.

16. The method according to claim 13, wherein the fuel has a boiling range from 120 to 500° C.

17. A composition of motor fuels or liquid hydrocarbon fuels the boiling temperature range of which is comprised between 100 and 500° C. comprising:

a major proportion of hydrocarbon compounds and/or vegetable and/or animal oils and/or their oil esters and/or biodiesels of animal and/or vegetable origin; and a minor proportion comprised between 5 and 5,000 ppm by mass, of at least one composition comprising:

(a) at least one modified alkylphenol-aldehyde resin capable of being obtained by Mannich reaction of an alkylphenol-aldehyde condensation resin:

(i) with at least one aldehyde and/or one ketone having 1 to 8 carbon atoms; and (ii) at least one hydrocarbon compound having at least one alkylmonoamine or alkylpolyamine group, having between 4 and 30 carbon atoms;

the alkylphenol-aldehyde condensation resin itself being obtained by condensation:

(iii) of at least one alkylphenol substituted by at least one linear or branched alkyl group, having 1 to 30 carbon atoms;

(iv) with at least one aldehyde and/or one ketone having 1 to 8 carbon atoms; and (b) at least one filterability additive chosen from:

(i) terpolymers of $C_4$ to $C_{22}$ alkyl (meth)acrylate, $C_{20}$ to $C_{24}$ alpha-olefin and maleimide N-substituted by a hydrocarbon chain having between 4 and 30 carbon atoms;

(ii) the homopolymers of $C_1$ to $C_{40}$ alkyl (meth)acrylate;

(iii) the ammonium salts of mono- or poly-carboxylic acid comprising at least one linear or branched, saturated or unsaturated hydrocarbon chain and having between 4 and 30 carbon atoms.

18. The additive composition according to claim 1, wherein the aldehyde and/or ketone has 1 to 4 carbon atoms.

19. The additive composition according to claim 1, wherein the homopolymers of $C_1$ to $C_{40}$ alkyl (meth)acrylate are $C_8$ to $C_{24}$ alkyl (poly)acrylates.

20. The method according to claim 14, wherein the fuel has a boiling range from 120 to 500° C.

* * * * *